United States Patent [19]

Barczynski et al.

[11] 3,955,094

[45] May 4, 1976

[54] RADIANT ENERGY EMITTER FOR COLOR CRT FABRICATION

[75] Inventors: J. Robert Barczynski, Waterloo; Jerry F. Janssen, Seneca Falls, both of N.Y.

[73] Assignee: GTE Sylvania Incorporated, Stamford, Conn.

[22] Filed: Mar. 13, 1975

[21] Appl. No.: 557,877

[52] U.S. Cl. ..... 250/527

[51] Int. Cl.[2] ..... B01K 1/00

[58] Field of Search ..... 250/527

[56] References Cited

FOREIGN PATENTS OR APPLICATIONS 26,922 10/1965 Japan ..... 250/527

*Primary Examiner*—Howard S. Williams

*Attorney, Agent, or Firm*—Norman J. O'Malley; Frederick H. Rinn; Robert T. Orner

[57] ABSTRACT

The invention provides radiant energy emission means utilized in an apparatus for discretely photo-exposing sensitized coatings disposed on the sidewall portion of a color cathode ray tube glass face panel. The emission means includes a source of radiant energy and an associated transparent energy transmission medium in the form of a cylindrical collector rod positioned in a manner whereof the output portion thereof extends within the panel. The cylindrical surface of the output portion within the panel is abraded to laterally emit exposure radiation radially outward toward the sidewall of the panel.

6 Claims, 9 Drawing Figures

RADIANT ENERGY EMITTER FOR COLOR CRT FABRICATION

CROSS REFERENCE TO RELATED APPLICATION

This application contains matter disclosed but not claimed in a related United States patent application filed concurrently herewith and assigned to the assignee of the present invention. This related application is Ser. No. 557,966.

BACKGROUND OF THE INVENTION

This invention relates to the manufacture of color cathode ray tubes and more particularly to exposure means for aiding the fabrication of the basic structure of a patterned color screen on the viewing panel of a color cathode ray tube.

Cathode ray tubes capable of presenting multi-colored display imagery, such as those employed in color television applications, conventionally utilize face panels having viewing areas whereupon patterned screens are interiorly disposed; such screens being comprised of repetitive groupings of related cathodoluminescent phosphor materials. For example, in certain types of the well-known shadow mask tube construction, the screen pattern is conventionally composed of a vast multitude of similarly-shaped phosphor elements definitively separated by relatively small interstitial spacings purposely provided to enhance the color purity of the imagery by reducing the possibility of happenstantial electron excitation of adjacent elements.

To enhance brightness and contrast of the color screen image, an opaque light-absorbing material is often disposed in the interstitial spacing to effect a basic multi-windowed construction or webbing for defining the respective phosphor elements of the screen pattern. It is important that this graphite coating, applied to the interior of the panel during formation of the webbing, be subsequently removed from the sealing edge of the panel and for a fixed distance therefrom up the sidewall of the panel to provide a peripherally defined outline of the basic windowed structure. Any residual graphite adhering to the sealing edge of the panel interferes with the subsequent formation of the hermetic jointure between the panel and the funnel. In addition, since graphite is electrically conductive, any particles thereof remaining on or around the mask supporting studs embedded in the panel sidewall may be dislodged by movement of the mask locating members and thereby constitute a potential source of deleterious electrical shorts and arcing in the finished tube.

It is a desideratum from both aesthetic and quality considerations, that the basic windowed webbing of the screen structure be framed by a circumscribing opaque peripheral area having a smoothly defined trim line along the upper portion of the panel sidewall in the region proximal to the viewing area. Such definition is desired as subsequent aluminizing of the completed screen should overlay all of the screen area including the opaque periphery therearound. In the completed panel, the remainder of the sidewall below the trim line, and the sealing edge therearound should be free of both graphite and aluminum.

In one procedure for fabricating the basic windowed webbing portion of the screen structure, the interior of the panel is coated with a negative photosensitized material, such as a dichromated aqueous-alcohol solution of polyvinyl alcohol whereupon the viewing area of the panel is then plurally exposed by actinic radiation emanating from discretely positioned sources and directed through the openings of the shadow mask to polymerize a similarly-shaped pattern in the sensitized coating therebeneath. The exposed coating is then developed to remove the unpolymerized areas, thereby providing a basic polymerized screen format pattern surrounded by a web pattern of substantially bare glass. The whole of the interior of the panel is then overcoated with a graphite material and subsequently treated with an appropriate degrading agent, to effect an effervescent degradation of the polymerized portions of the patterned screen format, such degradation also loosening the graphite overcoating the polymerized areas. The loosened materials are then removed by development to produce an opaque interstitial web defining multitudinous bare glass windows wherein the respective phosphor elements of the screen structure are subsequently disposed. Since the aforedescribed degradation affects polymerized areas which are solely related to the viewing area of the panel, the balance of the panel including the sidewall, the mask positioning studs therein, and the sealing edge therearound, remain coated with graphite.

By one conventional procedure, the extraneous graphite coating is removed from the panel edge and a portion of the adjacent sidewall by immersing the sealing edge of the panel into a suitable acid solution to chemically etch away the undesired graphite coating, trimming it to the level determined by the depth of immersion. While this method efficiently removes the graphite from the sealing edge, it manifests two deleterious results. First, by immersing the panel into the acid solution far enough to remove graphite from the mask positioning studs, there is the inherent danger of splashing acid upon the alreadyformed windowed webbing of the basic screen structure, thereby destroying the constancy of the pattern, and rendering the panel unusable for tube fabrication. If only shallow immersion of the panel sidewall is employed, it is necessary to clean the mask positioning studs by manual techniques, the results of which, are not uniformly consistent. Secondly, the acid immersion process of removing the graphite coating from the panel sidewall often results in the formation of a trim line having a jagged edge. Aside from the undesirable aesthetic appearance of panels trimmed by this procedure, there is a possibility that upon aluminizing, portions of the jagged graphite trim line may exhibit poor adherence and eventually produce loose particles within the tube.

An improvement has been developed in the procedure for fabricating the basic multi-windowed patterned portion of a color cathode ray tube screen structure formed on the interior of the face panel. This improvement involves additional photoexposure of the panel after the latent polymerized image of the window pattern has been formed on the viewing area and before development of that window pattern has been effected. This additional exposure is directed to that region of the sensitized coating adhered to the sidewall portion of the panel. To accomplish the sidewall exposure, the panel is positioned to facilitate orientation of an areal internal shielding member within the coated panel at a location substantially intermediate the viewing area and the mask positioning means embedded in the panel sidewall. This shielding member provides protection for the priorly-formed latent imagery of the window pattern during subsequent exposure of the pattern. At least one emitter of radiant energy is oriented relative to the shielding member and the sidewall of the panel, whereupon exposure of only that portion of the sensitized coating disposed on the sidewall is effected by a directed flood of exposure energy to provide a defined peripheral band of polymerized coating on the wall. The shielding member and the secondary emission means are thence removed from the vicinity of the panel, whereupon the diversely exposed areas of the coating on the interior of the panel are developed to remove the unexposed portions thereby providing a pattern of polymerized window areas on the viewing portion and a polymerized band on the panel sidewall. The interior of the panel is then conventionally overcoated with an opaque graphite material, and treated with a degrading agent to loosen and remove therefrom the polymerized material, along with the graphite deposited thereon. Removal of these degradation materials provides the interstitially defined window webbing of the basic screen structure on the viewing area which is circumscribed by a substantially bare glass sidewall wherein the mask positioning means and the terminal sealing edge therearound are free of coatings and particulate materials.

OBJECTS AND SUMMARY OF THE INVENTION

It is an object of the invention to provide a discrete radiant energy emitter for use in the aforedescribed photoexposure means whereby defined exposure of the sidewall portion of the face panel is accomplished. Another object is to provide a radiant energy emitter that is adaptable for utilization in the sidewall exposure of small-sized face panels.

These and other objects and advantages are achieved in one aspect of the invention by the provision of radiant energy emission means employed in an apparatus for photo-exposing senstitized coating disposed on the perimetrical sidewall portion of a color cathode ray tube glass face panel. The exposure apparatus incorporates an areal shielding member which is positioned within the panel to shield the viewing area thereof. The radiant energy emission means of the invention is oriented to radiate exposure energy in a manner substantially directionally parallel to the bottom of the shielding means toward the sidewall of the panel. The emission means includes a source of radiant energy encompassed within a compatible enclosure, and a transparent energy transmission medium in the form of a substantially cylindrical collector rod positioned to extend within the panel in a mode normal to the plane of the shielding means. The input portion of the collector is associated with the energy source, and the opposed output portion thereof is formed as a longitudinal section whereof the cylindrical surface is abraded to provide a radiation emissive surface to project exposure energy radially outward toward the sidewall.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

In those color cathode ray tubes employing a basic patterned windowed webbing in the screen structure, it has been a customary practice to fabricate the windowed web on the interior surface of the viewing portion of the face panel prior to the deposition of the respective cathodoluminescent elements of the screen per se.

Figure 1:
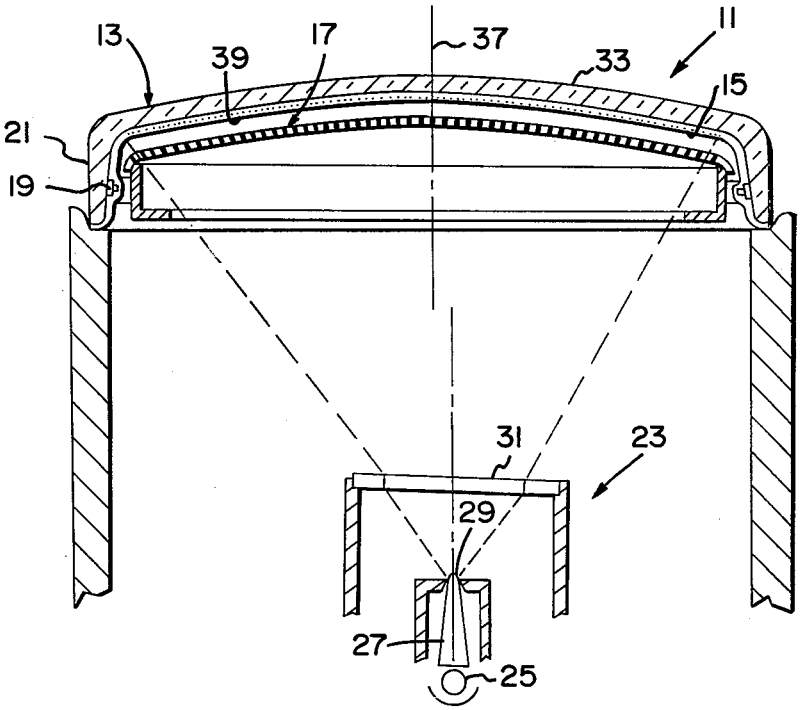
Fig. 1 PRIOR ART
FIG. 1 is a prior art sectional view illustrating the primary exposure apparatus utilized in forming the latent pattern imagery on the viewing area of the face panel.

With reference to the drawings, there is shown in FIG. 1 a prior art view of the primary exposure apparatus 11 employed in forming the discretely patterned windowed webbing on the face panel 13. Since the windows in the webbing are identical to the subsequent placement of respective phosphor elements comprising the screen, the exposure apparatus employed in forming the windowed web is substantially identical to that utilized for subsequent disposition of the respective phosphor elements. Prior to the exposure of each of the several window patterns comprising the webbing, the interior surface of the panel is coated with a light-hardenable negative photo-sensitive substance 15, such as dichromate sensitized polyvinyl alcohol, which is well known in the art. A multi-apertured shadowmask 17 is then oriented within the face panel on a plurality of spatially related mask positioning studs 19 partially embedded in the sidewall 21 of the panel. The mated mask-panel assembly is then suitably positioned on the primary exposure apparatus 11, wherein there are means for predeterminately positioning an optical system 23 comprising a radiant energy emitter 25, such as a ultra-violet emitting mercury vapor lamp, an associated tapered collector rod 27 terminally formed to provide a substantially point source of radiation 29, and a conjunctive lightrefractive medium or lens 31. In the primary exposure step, discrete areas of the coated viewing portion 33 of the panel are subjected to radiation emanating from the tip of the collector rod 27, refracted by the lens 31 and directed through the mask apertures 35 to impinge the photo-sensitive coating 15 on the viewing area of the panel. The discrete areas of the coating thus impinged are polymerized and adhered to the interior surface of the viewing area 33 to form a latent imprint of the window areas comprising the first pattern of the basic screen structure. This primary exposure step is twice repeated to dispose window imprints for the remaining elements comprising the screen combination. For the separate primary exposure of each of the respective window patterns, the components of the optical system, i.e., the radiant energy emitter 25, the associated collector rod 27 and the light-refractive medium 31 are properly repositioned relative to the axis 37 of the panel. It is to be noted that these multiple primary exposure steps have treated only the viewing area 33 of the panel, whereupon only the latent imagery 39 of the respective windowed patterns are effected as multitudinous polymerized areas surrounded by unpolymerized material, which extensively includes the coating covering the panel sidewall 21 and mask positioning studs 19 embedded therein. In the drawings, the thickness of the photosensitive coating 15 is accentuated to aid clarification of the description.

Figure 2:
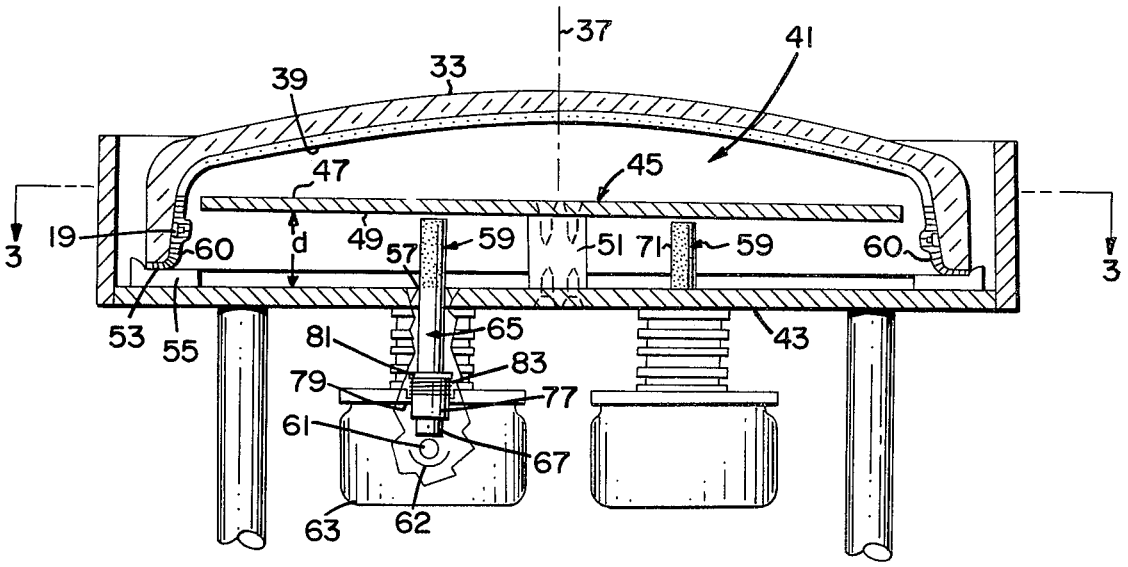
FIG. 2 is a sectional view of the secondary exposure apparatus employed in photo-exposing only a discrete circumferential area of the panel sidewall.
Figure 3:
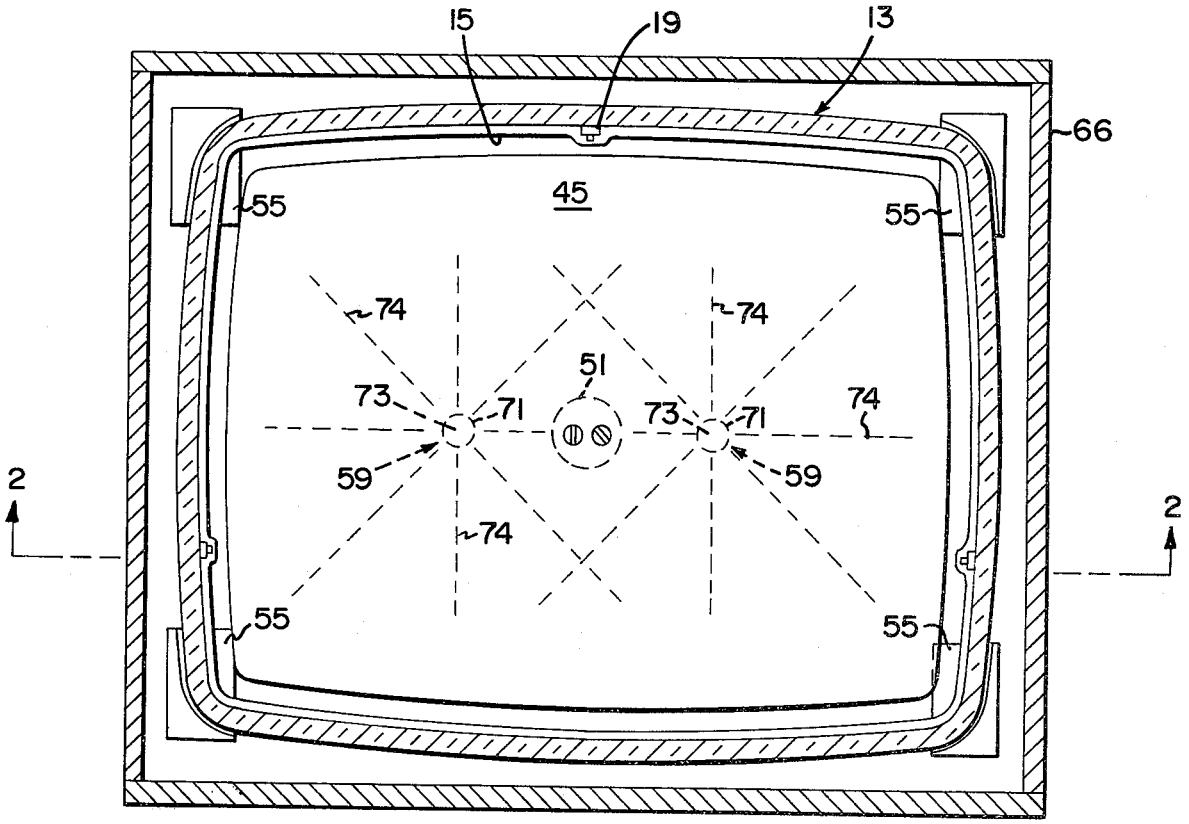
FIG. 3 is a plan view of the apparatus shown in FIG. 2 taken along the line 3-3 thereof.

After removing the shadowmask 17 from the interior of the panel 13, the coated panel is re-positioned for further exposure. Attention is directed to FIGS. 2 and 3 wherein there is shown the secondary exposure apparatus 41 for effecting discrete exposure of the panel sidewall. This exemplary secondary exposure structure includes a base member 43 from which an areal shielding member 45, having top 47 and bottom 49 surfaces, is supported in a standoff manner from the base member by a centrally oriented support means 51 which effects minimal shadowing of the exposure radiation. The shielding member 45 being preferably of metal, such as aluminum, is perimetrically contoured and dimensioned with sufficient clearance to be positioned within the panel in a manner to shield the priorly exposed viewing area 33 thereof. To consummate the positioning of the panel 13 and the shielding member 45 in the desired relationship, the sealing edge portion 53 of the panel is accommodated by a plurality of panel positioning means 55 located on the base member 43.

Protruding from suitable apertures 57, related to the base member 43, are a plurality of secondary radiant energy emission means 59 which are oriented within the interior confines of the panel 13 in the region relative to the bottom surface 49 of the shielding member 45; such surface being desirably reflective. In the secondary exposure apparatus as shown, at least two spaced apart emitter means 59 are positioned to beam exposure radiation in a manner substantially normal to the axis 37 of the panel, such radiation being directed substantially laterally toward the sidewall portion 21 of the panel, within the region defined by the related planes of the base and shielding members, to effect photo-polymerization of a defined band 60 of the sidewall-disposed coating. These respective light emission means 59 are each comprised of a brilliant source of radiant energy 61, such as a conventional mercury vapor lamp and associated reflective means 62; such being suitably encompassed within a compatible enclosure 63 located outward of the sealing edge 53 of the panel. Functionally related to each light source, is a transparent energy transmission medium in the form of a substantially cylindrical collector rod 65, formed for example of clear homogeneous vitreous silica, to provide effective transmission of actinic radiant energy from the light source 61 to the selected internal region of the panel 13.

The exposure apparatus 41 utilizes a continuous wall 66 therearound constructed perpendicular to the base member 43 to spatially encompass the panel. The internal surface of the wall is of a flat black finish to minimize reflections, the height being of a dimension to confine and restrict the exposure radiation to the desired perimetrical area of the panel sidewall 21.

Figure 4:
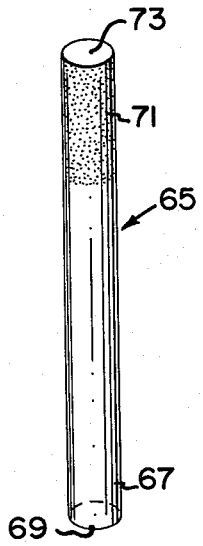
FIG. 4 is a perspective illustrating one embodiment of the collector rod such as shown in FIG. 2.

The cylindrical collector 65, which is further delineated as a first embodiment in FIG. 4, has an input portion 67 whereof the proximal end surface 69 is directly associated with the light source 61, and an output portion 71 having a distal end surface 73 oriented within the panel relative to the reflective bottom surface 49 of the areal shielding means. The cylindrical surface of the longitudinal output portion 71 of the collector is abraded therearound to provide a radiation emissive surface oriented to direct rays of actinic exposure energy 74 toward the panel sidewall 21. For the apparatus shown, the length of the longitudinal output portion 71 of the collector does not exceed the distance *d* between the base member 43 and the shielding member 45. Normally, the exterior cylindrical surface of the collector rod 65, including the proximal and distal end surfaces, is polished except for the extensive longitudinal abraded output portion 71. The cylindrical design of the collector effects efficient transmission of radiation from the lamp to the abraded output region. Since the distal end surface 73 is located close or contiguous to the reflective bottom surface 49 of the shielding member, any light projected through the distal end is reflected by the shielding member to augment the laterally directed actinic exposure radiation emanating from the abraded portion.

Exemplary mounting means for the collector rod may be in the form of a cylindrical retainer 77 having a bore therethrough of a diametrical dimension to accommodate retention of the rod. The retainer, which is positioned in a receiving opening 79 in the top of the enclosure 63, has a circumferential ledge 81 outstanding from the end thereof oriented outward of the enclosure. A helical spring 83 surrounds the retainer between the ledge and the enclosure opening to effect a resilient mounting of the collector. Such mounting means allows for longitudinal expansion of the collector resultant of the heat from the lamp 25. Thus, the distal end surface 73 of the collector, through expansion, may abut or make contact with the reflective bottom surface 49 of the shielding member 45.

Figure 5:
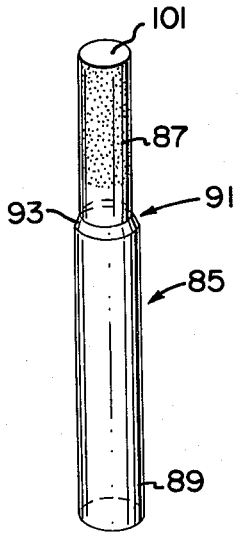
FIG. 5 is a perspective showing another embodiment of the collector rod.
Figure 6:
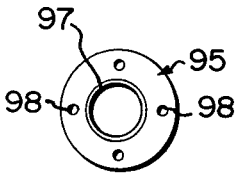
FIG. 6 is a plan view of the stop-collar employed with the collector rod illustrated in FIG. 5.
Figure 7:
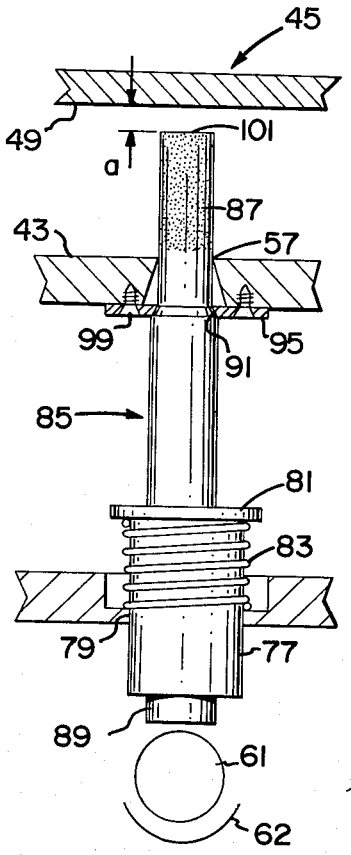
FIG. 7 is an enlarged side view portraying means for positioning the FIG. 5 embodiment in the secondary exposure apparatus.

A second embodiment of the collector rod 85, as delineated in FIGS. 5 through 7, is comprised of a duo-diameter structure whereof the abraded output portion 87 is of a diameter slightly smaller than that of the input portion 89. This collector being an integration of two related cylindrical portions of diverse diameters has an exterior annular ledge 91 evidencing a transitional taper 93 therearound. The taper of the transitional region is considered beneficial in promoting the efficiency of internal reflectances in the duo-diameter structure. With particular reference to FIGS. 6 and 7, there is shown a stopcollar 95 which has a substantially tapered aperture 97 therein of a diameter to accommodate the annular ledge of the rod 85. This collar means, having a plurality of mounting holes 48 therein, is suitably affixed, as by attachment means 99, to the base member 43 in a manner to arrest the protrusion or forward movement of the input portion 87 of the resiliently mounted collector into the panel. In this embodiment, the distal end surface 101 of the collector can be located at a predetermined distance *a* from the bottom surface of the shielding member 45. When so removed from the reflective shielding surface 49, it has been found beneficial to exteriorly dispose an interiorly reflective coating on the distal end surface 101 of the collector rod.

Figure 8:
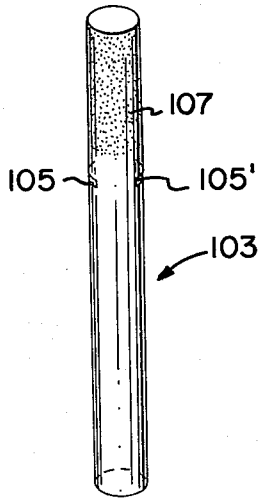
FIG. 8 is a perspective showing a third embodiment of the collector rod.
Figure 9:
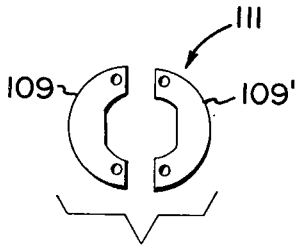
FIG. 9 is a plan view of the stop-collar means used in conjunction with the collector rod illustrated in FIG. 8.

Another embodiment of the collector rod 103 is illustrated in FIGS. 8 and 9, wherein a uni-diametered cylindrical collector rod is similar to that of the first embodiment 65, with the addition of a pair of oppositely disposed notches 105, 105'. These shallow depressions are formed in the rod 103 in the region adjacent the abraded output portion 107, to accommodate therein the opposed halves 109, 109' of the two-piece stopwasher 111, shown in FIG. 9. With the two halves of the stopwasher 111 placed in the respective notches, the rod is positioned in the aperture 57, whereupon the stop-washer is affixed to the base member 43. This embodiment likewise limits the protrusion of the output portion 107 into the panel.

The foregoing embodiments provide radiant energy emission means expressly tailored to radiate substantially laterally, and thus expeditiously effect discrete sidewall exposure of the panel.

As shown in FIGS. 2 and 3, the simultaneous excitation of two such radiant energy emitters exposes only that portion of the photosensitive coating 15 that is disposed on the wall of the panel including that covering the mask positioning studs 19. As a result, the confined and directed flood of secondary exposure radiation beneficially provides a defined band of polymerized coating 60 upon the sidewall of the panel.

Upon being subjected to such secondary exposure, the panel is thence removed from the shielding member and the associated secondary emission means, whereupon the diversely exposed areas of coating on the interior of the panel are developed to remove the unexposed portions, therey providing a pattern of polymerized window areas on the viewing portion 33 and a definitive polymerized band on the sidewall 21. Following development, the interior of the panel is conventionally treated to provide the interstitially defined windowed webbing of the screen area which is circumscribed by a bare glass sidewall 21 wherein the mask positioning studs 19 and the sealing edge 53 thereareound are free of coatings.

At this state of fabrication, the panel is prepared for the deposition of the respective phosphor elements comprising the color screen pattern.

While there has been shown and described what are at present considered the preferred embodiments of the invention, it will be obvious to those skilled in the art that various changes and modifications may be made therein without departing from the scope of the invention as defined by the appended claims.

What is claimed is:

1. In an apparatus for photo-exposing the perimetrical sidewall portion of a color cathode ray tube glass face panel having negative radiant energy sensitive coating interiorly disposed thereon, and wherein an areal shielding member is spatially supported above a base member in a manner to be positioned within said panel to shield the viewing area thereof, radiant energy emission means oriented to radiant exposure energy in a manner substantially directionally parallel to the bottom of said shielding means, said emission means comprising:

a source of brilliant radiant energy encompassed within a compatible enclosure located outward of the sealing edge of said panel; and a transparent energy transmission medium in the form of a substantially cylindrical collector rod positioned to extend within said panel normal to said shielding means, said collector having an input portion with a proximal end surface associated with said energy source and an outward portion having a distal end surface oriented within said panel relative to the bottom of said shielding means, said output portion comprising a longitudinal section of said collector rod having a length not exceeding the distance between said base and said shielding members, the cylindrical surface of said output portion being abraded to provide a radiation emissive surface to direct exposure energy substantially radially outward toward said panel sidewall.

2. Radiant energy emission means according to claim 1 wherein said collector rod is formed of homogeneous vitreous silica providing effective transmission of ultraviolet radiant energy, and whereof the exterior cylindrical surface is polished except for the extensive abraded region comprising said output portion.

3. Radiant energy emission means according to claim 2 wherein said collector rod is shaped to provide a duo-diameter structure whereof said output portion is of a diameter smaller than that of said input portion, said integrally related cylinders having an exterior annular transition ledge therebetween to accommodate a stop means for limiting the distance of protrusion of said input portion into said panel.

4. Radiant energy emission means according to claim 2 wherein said cylindrical collector rod has a pair of oppositely disposed notches penetrating the cylindrical surface of said rod in a manner normal thereto to accommodate stop means for limiting the distance of protrusion of said output portion into said panel.

5. Radiantenergy emission means according to claim 2 wherein both the proximal and the distal end surfaces of said collector rod are polished.

6. Radiant energy emission means according to claim 5 wherein said distal end surface of said rod has an interiorly reflective coating disposed exteriorly thereover.

* * * * *